US005167368A

United States Patent [19]

Nash

[11] Patent Number: 5,167,368

[45] Date of Patent: Dec. 1, 1992

[54] DECORATIVE WATERFALL

[76] Inventor: John Nash, P.O. Box 311, Kula, Hi. 96790

[21] Appl. No.: 777,160

[22] Filed: Oct. 16, 1991

[51] Int. Cl.[5] ..... B05B 17/08

[52] U.S. Cl. ..... 239/17; D23/201

[58] Field of Search ..... 239/16, 17, 18, 20, 239/22, 23, 21, 124; D23/201

[56] References Cited

U.S. PATENT DOCUMENTS

| | | | |
|---|---|---|---|
| 1,322,803 | 11/1919 | MacFadden | 239/17 |
| 3,211,378 | 10/1965 | Zysk | 239/17 |
| 3,212,713 | 10/1965 | Chatten | 239/17 |
| 3,409,223 | 11/1968 | Gosh | 239/17 |
| 3,921,902 | 11/1975 | Erickson et al. | 239/17 |
| 4,111,363 | 9/1978 | Kawamura et al. | 239/17 |
| 4,747,538 | 5/1988 | Dunn et al. | 239/23 |
| 4,836,142 | 6/1989 | Duback | 239/23 |

FOREIGN PATENT DOCUMENTS

| | | | |
|---|---|---|---|
| 260375 | 10/1912 | Fed. Rep. of Germany | 239/18 |

*Primary Examiner*—Andres Kashnikow
*Assistant Examiner*—Christopher G. Trainor
*Attorney, Agent, or Firm*—John K. Donaghy

[57] ABSTRACT

A decorative waterfall comprises a housing having a top and bottom and a front and back wall; a reservoir for water in the bottom of the housing; a reservoir for water at the top of the housing; a pump for conveying the water in the bottom reservoir to the top reservoir, whereby the water overflows the top reservoir and flows down the front wall; and at least one indenture for creating a sound resembling the sound of a natural waterfall.

10 Claims, 3 Drawing Sheets

DECORATIVE WATERFALL

BACKGROUND OF THE INVENTION

1. Field of the Invention

This invention pertains to waterfalls and specifically to a unitary waterfall for providing a decorative visual and acoustical effect resembling that of a natural waterfall.

2. Background of the Prior Art

The prior art shows water fountains where water is re-circulated from an upper portion of the fountain downwardly to a pool thereby creating a waterfall effect.

Representative of the prior art devices are the following list of patents. Copies are furnished herewith for the record.

| | | |
|---|---|---|
| Cushman | 2,877,051 | Re-circulating fountain |
| Zysk | 3,211,378 | Wall fountain |
| Keeler | 4,217,315 | Humidifier and moving indoor sculpture |
| Cacoub | 5,005,762 | Decoration or utilitarian water-using equipment |
| Pan | 303,422 | Fountain |

Cushman '051 shows a fountain device having a rotary bailing wheel for raising water from a pool to a higher level where it falls by gravity back to the pool.

Zysk '378 discloses a wall fountain having a pool of water and a pump for raising water upwardly to a higher level where it falls over a vertical wall back to the pool.

Keeler '315 is a decorative display comprising a rotative helix and a pool of water where water is caused to be elevated to the top of the helix and then flows down the helix in a decorative manner.

Cacoub '762 shows a decorative device using droplets of water to create a decorative atmosphere.

Pan '422 is a design of a fountain having an animal head on a vertical wall.

SUMMARY OF THE INVENTION

It is noted that the reasons for the acoustics created by a natural waterfall is the open spaces or indentures or crevices created in the wall behind the flow of water.

It is an object to provide a waterfall having a natural visual waterfall effect with accompanying acoustical effects.

It is another object of this invention to provide a waterfall having a front wall which may be varied from a vertical to a sloping surface over which water is caused to flow thus creating a natural waterfall effect.

It is still another object of this invention to provide a waterfall having a lower reservoir for water, an upper reservoir with overflow means and means for conveying the water in the lower reservoir to the top reservoir where it overflows the upper reservoir and returns to the lower reservoir in a waterfall fashion.

And still another object of this invention is to provide a waterfall with a front wall having a bottom edge terminating a distance above the water in the lower reservoir and an indenture or space between the bottom edge and a rear wall which creates a sound resembling the sound of a natural waterfall.

Another object of this invention is to provide a waterfall having at least one space or indenture in the front wall for effecting the sounds of rushing water resembling a natural waterfall.

The invention contemplates a unitary structure which may be placed at any location or moved from place to place as needed. It may be incorporated in a wall of any structure to provide a pleasant scenery. This unitary structure may include multiple units capable of being joined together to form one geometrical structure with multiple waterfalls.

These and other objects of the invention will become apparent to those skilled in the art to which the invention pertains from a reading of the following specification when taken in light of the annexed drawings.

DESCRIPTION OF THE PREFERRED EMBODIMENT OF THE INVENTION

Figure 1:
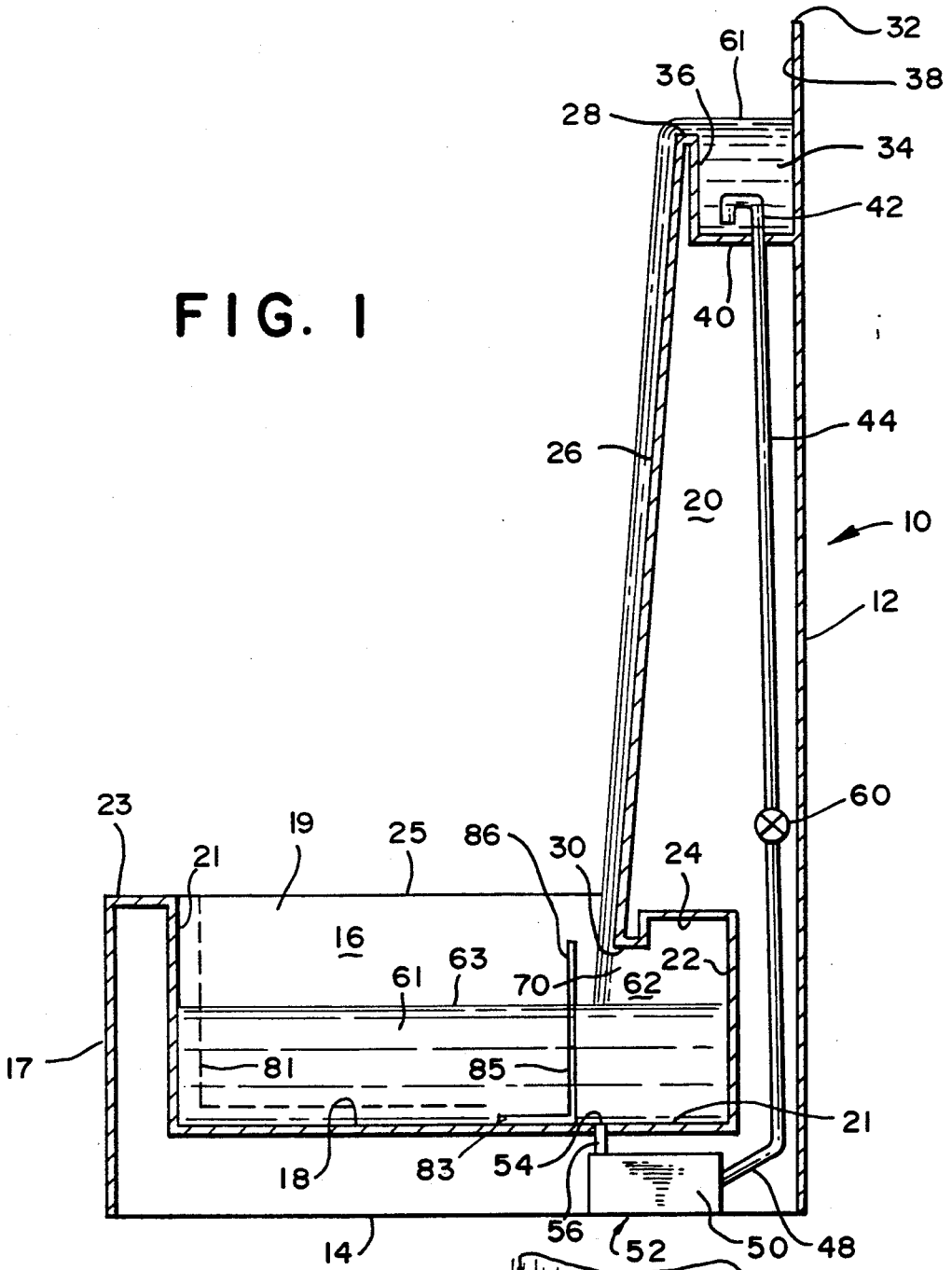
FIG. 1 is a vertical cross-sectional view of the waterfall showing a lower reservoir, a top reservoir and a front wall over which water flows from the top reservoir to the bottom reservoir.
Figure 2:
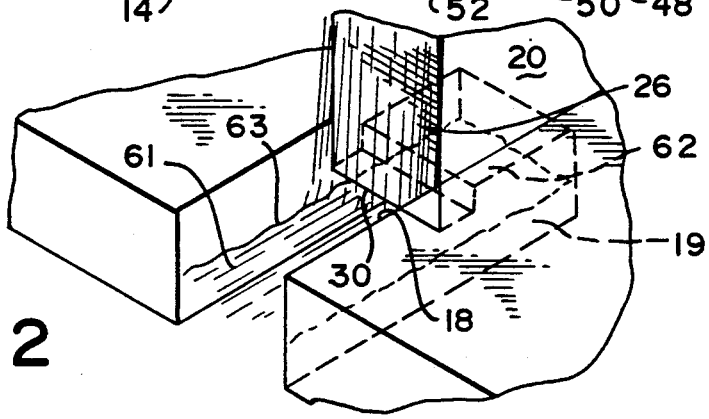
FIG. 2 is an enlarged view of an indenture created by the bottom edge of the front wall and the back wall of the waterfall.
Figure 6:
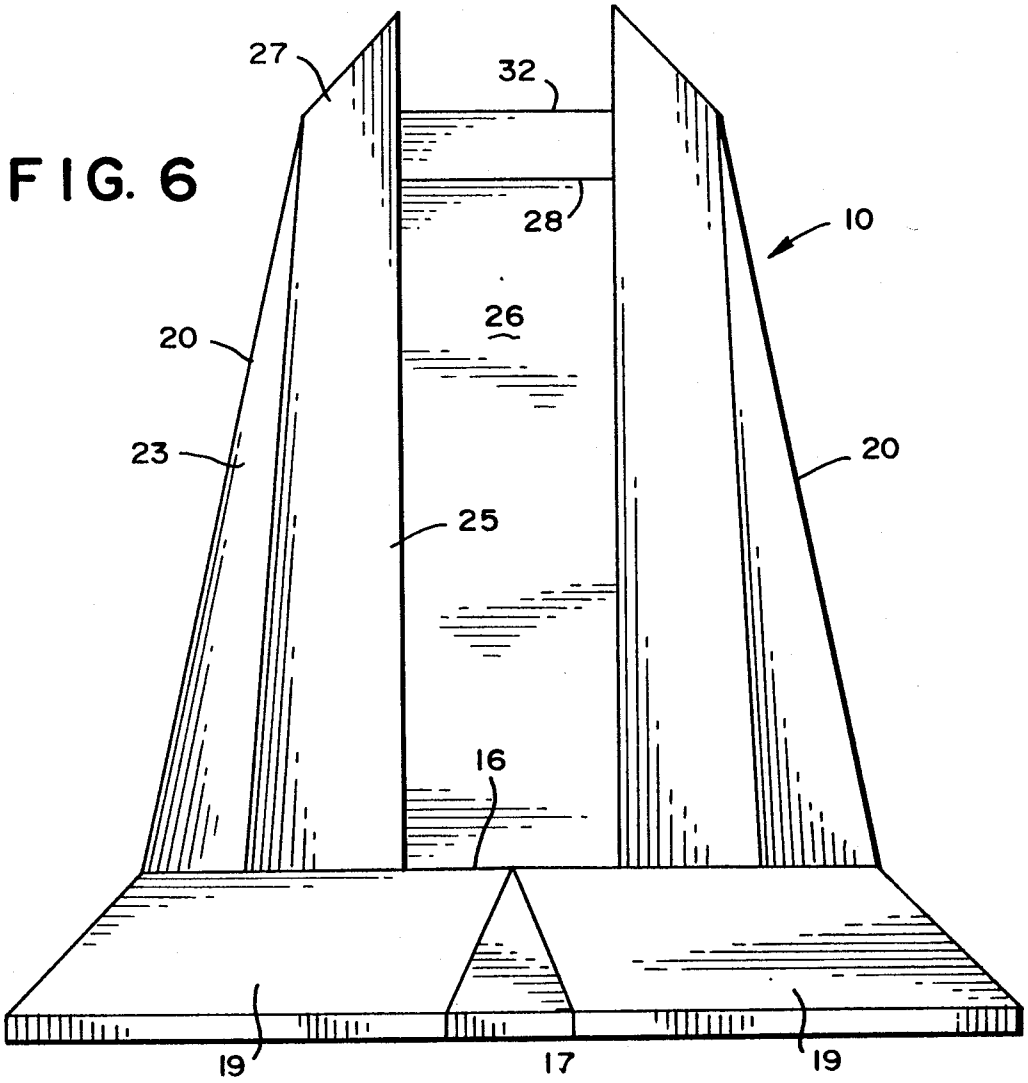
FIG. 6 is a front view of the invention.

Referring now in more detail to the drawings, FIGS. 1 & 6 show a waterfall 10 comprising a unitary housing having a back wall 12 of any desired length and width. It will be seen that the wall 12 joins a bottom 14 from which extends a vertical wall 17. Side walls 19 join the back wall 12, the bottom 14 and the wall 17 to define a lower reservoir 16 for water. Side walls 20 comprising an integral triangular portion 23 and a generally rectangular portion 25 having triangular top 27 join the back wall 12 and a front wall 26 on either side to provide a closed unitary structure having the reservoir 16 with a bottom 18 between the inner face 21 of wall 17 and the inner face 22 of the back wall 12. It will be seen that the inner face 22 is substantially shorter than the vertical wall 12 and is joined by an inner wall 24. The front wall 26 has a top edge 28 which is lower than the top edge 32 of the back wall. The lower edge 30 of the front wall 26 terminates a distance above the surface of the water in the reservoir 16.

The upper reservoir 34 is created by the front wall portion 36, back wall portion 38 and the side walls 20. The bottom 40 of the reservoir 34 has an opening for the passage of an end 42 of a conduit 44 having a lower end 48 attached to a pump 50 which is flush in an opening 52 in the bottom 14. The bottom 18 of the reservoir 16 has an opening 54 which is connected to the pump inlet 56. A valve 60 in the conduit 44 provides for adjusting of the volume of water pumped by the pump 50 from the lower reservoir 16 to the top reservoir 34. The pump 50 may be any suitable type and have an electric cord for connection to a source of electricity. A switch to operate the pump will be at any suitable location—say on the back wall 12, for example. The pump may be submerged in the lower reservoir at any location with suitable water tight seals for electrical wiring and switches.

A space or indenture 62 is created by the back wall portion 22, and inner wall portion 24, and the sides 19, and that portion 21 of the bottom 18. It will be seen that edge 30 of the wall 26 is a distance above the top 63 of the water 61. This distance may be varied by lowering or raising the edge 30.

In operation, the reservoir 16 is filled with water to a sufficient volume such that there is a free space 70 between the edge 30 and the top 63 of the water 61. The pump 50 is switched on whereby the water from the pool 16 is pumped into the reservoir 34 which then flows over the top edge 28 and flows downwardly over the face of the wall 26 into the pool 16. The water falls over the bottom edge 30 of the wall 26 and free falls a distance 70 into the reservoir 16. The force of the water falling into the pool 16 creates a sound which reverberates against the back wall 22 and is amplified by the hollow indenture 62. The resulting sound resembles that of a natural waterfall in nature. The indenture or space 62 may be created in smaller or larger dimensions so as to achieve the desired acoustical effect of a natural waterfall.

The valve 60 may be adjusted to allow variable volumes of water to flow into the reservoir 34 whereby more rushing water may flow down the wall 26 and over the edge 30. The greater the rushing of water over the edge 30, the greater the acoustical effect.

It will be understood that the front wall 26 may be varied from vertical to slightly sloped to create a predictable flow of water into the pool. Further, the device may be constructed from prefabricated sections and assembled on site where, for example, a large unit is to be built. The device may be connected to an existing structure by any suitable construction technique.

A removable splash guard has a wall 85 that is set out a distance of about one inch from the edge 30 so that water falls unimpeded into the bottom reservoir. The bottom 83 of the splash guard rests on the bottom 18. It will be understood that the splash guard is in the form of a removable tray or shield which fits into the reservoir 16. Its top edges 86 will be approximately the same height as the top edges 23 and 25 of the walls 17 and 19.

The indenture or space 62, as defined above, is critical to achieving the natural-like waterfall sound effect. As the water falls down the face of the front wall, it reaches the bottom edge 30 and then free falls a distance to the pool. The sound of the water falling into the pool is reverberated against the back wall 22 of the indenture 62 and out the opening 70 into the space where the waterfall is located, such as a room or a garden or the like. The distance from the edge 30 of the front wall to the pool may vary to create a larger or smaller indenture 62. The indenture 62 may be of various dimensions and each change in dimension would effect a subtle change in acoustics.

Figure 3:
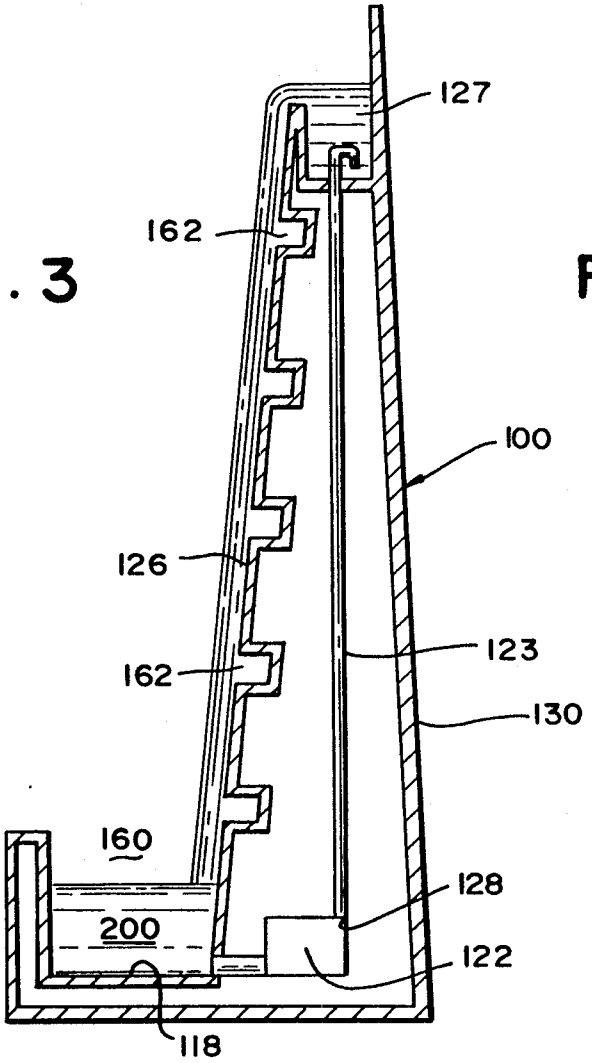
FIG. 3 is a vertical cross-sectional view of the waterfall showing a front wall having multiple indentures in the form of scores.

FIG. 3 shows a modified waterfall 100 having a bottom reservoir or pool 160 with water 200 therein. The front wall 126 has a series of indentures 162 in the form of scores which extend across the face of the wall. The indentures or spaces 162 may be spaced from each other such as to achieve multiple horizontal scores separated by a short distance from each other. Thus, it will be appreciated that multiple indentures 162 on the wall 126 create multiple sound effects resembling water rushing over a wall having naturally occurring spaces or crevices in the face thereof. A pump 122 on the bottom 18 is connected to the conduit 123 whereby the water in the bottom reservoir is pumped to the top reservoir 127. A switch for the pump may be placed at any convenient location outside the housing.

Figure 4:
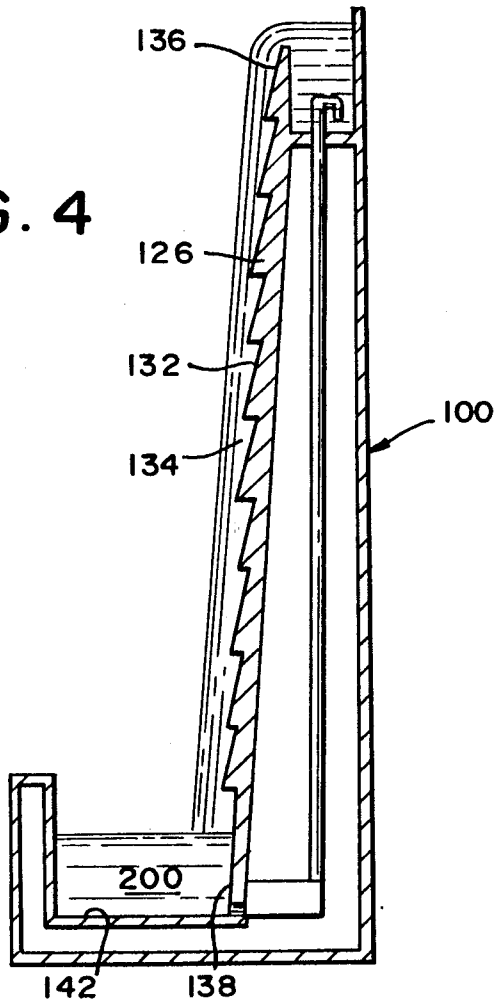
FIG. 4 is yet another vertical cross-sectional view of the waterfall having a front wall with multiple indenture in the form of louvers.

FIG. 4 shows another modification of the waterfall 100 where the vertical front wall 126 is a louvered surface created by the zigzag-zag 132 thus creating multiple indentures or spaces 134 from the top 136 to the bottom 138 which terminates at the bottom 142.

Figure 5:
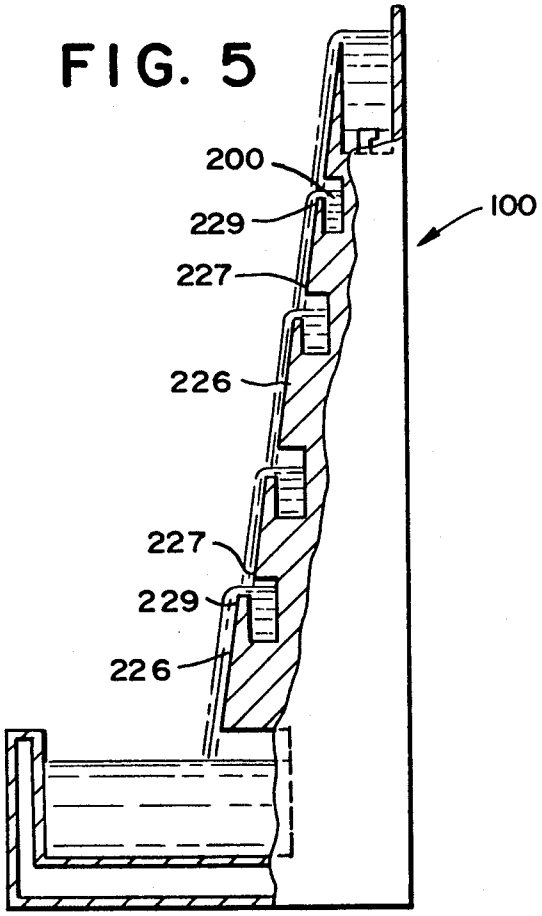
FIG. 5 is a vertical cross-sectional view of another modified view of the waterfall having multiple pools in the front wall.

FIG. 5 is yet another modification of the waterfall 100 showing multiple pools 200 indented in the front wall 226. These pools 200 extend across the front wall 226 and are spaced from each other a distance. It will be apparent that each wall 226 is set back from each other so as to provide a lower edge 227 which is set inward a distance from each upper edge 229. In this regard, the water falls over each edge 227 and into each pool 200. Thus, the multiple indentures or pool 200 provides an alternate method of obtaining a waterfall effect.

While the invention has been described with regard to a preferred embodiment thereof, it will be appreciated by those skilled in the art to which this invention pertains that numerous changes may be made therein to create a natural looking and sounding waterfall without departing from the spirit and scope thereof.

What is claimed is:

1. A decorative waterfall comprising:

a housing having a back wall, a front wall, and side walls joined to said back wall and said front wall;

a reservoir for water at the top of the housing defined by the back wall, side walls and front wall;

a reservoir of water in the bottom of the housing;

said front wall having a lower edge terminating a distance above the surface of the water in the bottom of the housing;

means for conveying the water in the bottom reservoir to the top reservoir where it overflows the top reservoir and flows down the front wall over said lower edge in the front wall into the bottom reservoir; and indenture means in the front wall adjacent said lower edge for amplifying the sound of the water flowing over said lower edge thereby creating a sound of a natural water fall.

2. A decorative waterfall according to claim 1, wherein: said means for conveying the water from the bottom reservoir to the top reservoir is a pump means.

3. A decorative waterfall comprising:

a housing having a back wall, a front wall having a lower edge, and side walls joined to the back wall and the front wall;

a reservoir for water at the top of the housing;

a pool of water in the bottom of the housing;

said lower edge of said front wall terminating a distance above said pool of water;

means for conveying the water in the pool to the reservoir where it overflows the reservoir and flows down the front wall and over said lower edge into the pool; and indenture means in the front wall above said pool for amplifying the sound of water flowing over said lower edge thereby creating acoustics resembling a natural water fall.

4. A decorative waterfall according to claim 3, wherein:

said reservoir for water in the top of the housing defined by a back wall portion, a front wall portion and said side walls, said front wall portion being lower than said back wall portion whereby said water in the reservoir overflows said front wall, and flows down said front wall over said edge into said pool of water.

5. A decorative waterfall according to claim 3, wherein:

said indenture means is a hollow space defined by the front wall lower edge, the back wall, the side walls, and the surface of the water in the pool of water, said hollow space effecting amplification of the sound of water falling over said lower edge into the pool of water.

6. A decorative waterfall according to claim 3, wherein:

said front wall is a vertical wall, said back wall is a vertical wall, and said side walls comprise a triangular portion and a rectangular portions having triangular tops.

7. A decorative waterfall according to claim 3, wherein:

said front wall is a sloped wall.

8. A decorative waterfall according to claim 3, and a splash guard in the pool of water having a wall set out a distance from said lower edge whereby water falls unimpeded into the pool of water.

9. A decorative waterfall according to claim 8, wherein:

said splash guard is a removable tray resting on a bottom of said pool of water.

10. A decorative waterfall according to claim 3, wherein said indenture means comprises a plurality of indenture means in the front wall and wherein said front wall includes a plurality of edges, the water flowing over each of said edges into the respective said indenture means.

* * * * *